United States Patent [19]

Brackmann et al.

[11] 4,059,121

[45] Nov. 22, 1977

[54] FILTER FOR TOBACCO SMOKE

[75] Inventors: Warren A. Brackmann, Cooksville; Daniel Di Ianni, Toronto, both of Canada

[73] Assignee: Rothmans of Pall Mall Canada Limited, Toronto, Canada

[21] Appl. No.: 544,292

[22] Filed: Jan. 27, 1975

Related U.S. Application Data

[63] Continuation-in-part of Ser. No. 352,868, April 20, 1973, Pat. No. 3,882,877.

[51] Int. Cl.[2] ..... A24D 1/04

[52] U.S. Cl. ..... 131/269; 131/10 R

[58] Field of Search ..... 131/10–10.9, 131/261–269

[56] References Cited

U.S. PATENT DOCUMENTS

| | | | |
|---|---|---|---|
| 2,688,380 | 9/1954 | MacHenry | 131/269 UX |
| 2,761,798 | 9/1956 | Knudson | 131/266 |
| 2,916,038 | 12/1959 | Wade | 131/269 X |
| 3,081,519 | 3/1963 | Blades et al. | 131/269 X |
| 3,119,396 | 1/1964 | Tanquary | 131/269 X |
| 3,347,247 | 10/1967 | Lloyd | 131/10.7 |
| 3,412,737 | 11/1968 | Pinter et al. | 131/10.7 X |
| 3,416,540 | 12/1968 | Lidums | 131/10.7 X |
| 3,461,880 | 8/1969 | Stubblefield | 131/10.7 X |
| 3,595,245 | 7/1971 | Buntin et al. | 131/269 |
| 3,656,484 | 4/1972 | Roberts et al. | 131/268 |

*Primary Examiner*—Robert W. Michell
*Assistant Examiner*—V. Millin
*Attorney, Agent, or Firm*—Sim & McBurney

[57] ABSTRACT

A tobacco smoke filter comprising a single filter element consisting wholly of a plurality of randomly-oriented non-crimped smooth-surfaced solid fibers of thermoplastic polymeric non-absorbent material, each of the fibers having a uniform diameter less than about 5 microns. The filter element has a generally circular cross-section taken across the intended flow path of the tobacco smoke and a diameter substantially equal to the diameter of a tobacco smoke flow path. The weight of polymeric material exceeds about 6 mg and the filter element has a pressure drop thereacross of from 1 to 10 inches of water at a flow rate of 17.5 ml/sec.

16 Claims, 2 Drawing Figures

FILTER FOR TOBACCO SMOKE

REFERENCE TO RELATED APPLICATION

This application is a continuation-in-part of U.S. Application Ser. No. 352,868 filed Apr. 20, 1973 (now Patent No. 3,882,877).

FIELD OF INVENTION

This invention relates to filters for tobacco smoke, more particularly to cigarette filters.

BACKGROUND TO THE INVENTION

Tobacco smoke essentially consists of a dispersion of solid and liquid particles in air, and this dispersion will be referred to as an aerosol in this specification. The aerosol is extremely stable due to the small size of the particles concerned and hence gravity has a negligible effect compared with the effect of convection currents and Brownian movement. Tobacco smoke is thought to contain constituents injurious to health and many suggestions have been made of filters to at least partially remove constituents of the smoke prior to entry into the smoker's mouth.

Tar and nicotine values of tobacco smoke entering the smoker's mouth, i.e., after filtration, are considered by Government bodies to be a significant indication of the effectiveness of a filter to remove injurious components of tobacco smoke. While it is possible by filtration to achieve very low levels of tar and nicotine values in tobacco smoke, frequently this is at the expense of taste and smoker satisfaction. For example, the filter may not allow adequate quantities of smoke to pass through the filter owing to the filter density required to achieve the low tar and nicotine level and hence the "draw" of the cigarette may not be satisfactory to the consumer.

Tobacco smoke filters of polyolefin have been suggested heretofore in U.S. Pat. No. 2,966,157. However, the fibers forming this prior art filter medium have diameters considerably in excess of 5 microns and are crimped.

Crimping of the filamentary material for tobacco smoke filters usually is considered necessary in order to displace portions of the individual filaments at angles to the axis of the filter tow so that, in the filter, these displaced portions of the filaments will be disposed across the flow path of the tobacco smoke for intercepting the particles to be filtered from the smoke. The crimping and crimp-deregistering operations are particularly critical to the production of high quality filters from cellulose acetate filaments and have been thought to be necessary for polyolefin fibers, as described in U.S. Pat. No. 2,966,157 referred to above. However, such operations add materially to the cost of production, and unless they are carried out with care, products lacking in uniformity are apt to result. It has been found that the fibers used in the filters of the present invention do not require the crimping of the individual fibers to provide effectiveness.

SUMMARY OF INVENTION

In accordance with the present invention, there is provided a filter for tobacco smoke which decreases tar and nicotine levels in the smoke to low values while, at the same time, providing a filter having satisfactory draw properties and enhanced "taste" properties. The invention also is directed to a tobacco smoke filtering method utilizing the filter elements.

Accordingly, the present invention is concerned with a tobacco smoke filter consisting wholly of or including elements consisting wholly of randomly-oriented, non-crimped, smooth-surfaced solid fibers of thermoplastic natural or synthetic polymeric, non-absorbent material, each of the fibers having a uniform diameter less than about 5 microns.

GENERAL DESCRIPTION OF INVENTION

The filter elements of the present invention, whether the sole filter element or combined with other filter elements to provide a self-sustaining filter structure for cigarettes, are of generally circular cross-section of diameter substantially equal to the diameter of the flow path of the tobacco smoke.

The novel filter element may have any convenient shape consistent with its generally circular cross-section taken across the intended flow path of the tobacco smoke. For example, the filter element may be in the form of a flat disc or in the form of a ball of filter material.

The fibers in the novel filter element are in a randomly-oriented form, although they may be predominantly oriented transverse to the flow path of the tobacco smoke, if desired. The randomly-oriented mass of fibers may contain predominantly long fibers which provide a self-sustaining structure. Alternatively, and more usually, the randomly-oriented mass of fibers contains predominantly short fibers which are supported in disc form on a tobacco smoke-permeable backing.

In the novel filter element, the quantity of polymeric material used should exceed about 6 milligrams. It has been found that this quantity of material is necessary to achieve a high degree of removal of tar and nicotine from the tobacco smoke. It also has been found that increasing the quantity of polymeric material substantially in excess of this minimum quantity does not significantly affect the removal of tar and nicotine from the tobacco smoke. In this invention, in order to avoid any possible difficulties arising from saturation of the filter element by liquid filtered from the aerosol, it is preferred to use a quantity of polymeric material of about 10 milligrams.

The pressure drop across the novel filter of the element may vary upwardly from a value of about 1 inch of water at the Standard Flow Rate of 17.5 ml/sec. at STP. Where, hereinafter, pressure drops are mentioned, the values are determined at the Standard Flow Rate. The filter element usually has a pressure drop of about 1 to 3 inches of water.

Physical compression of the novel filter element has been found to increase its filtering efficiency and the novel filter element may be compressed to the extent required to produce a pressure drop of up to about 10 inches of water. Usually, compression to the extent required to provide a pressure drop of about 7 inches of water is used.

The fibers present in the filter elements of the invention are formed of non-absorbent polymeric material, have smooth external surfaces and are solid and non-crimped. The fibers also critically have a uniform small diameter, less than about 5 microns, typically about 1 to 2 microns.

Comparisons of filtration of tobacco smoke utilizing filter elements formed from polymeric fibers having a uniform diameter less than about 5 microns and from polymeric fibers having a uniform diameter greater than about 5 microns, typically about 10 microns, indicates a superior degree of filtration is obtained with the filter elements formed from polymeric fibers having a uniform diameter less than about 5 microns, and the superiority is most marked when the fiber diameter is about 1 to 2 microns.

The mechanism of filtration involved in the present invention and resulting in a high degree of removal of tar and nicotine from tobacco smoke is not completely understood but it is theorized that the mechanism is as follows. Tobacco smoke aerosol consists of a wide range of particle sizes, many of very small diameters, typically about 0.1 to 0.6 microns. Due to the uniformly small diameter of the fibers used in the novel filter elements, the aerosol particles collide with the fibers and are impinged thereon, thereby removing the particles from the aerosol. In contrast, where fibers of conventional filter fiber size are used (typically about 10 to 25 microns average diameter) the particles are displaced by air flow slip lines around the fibers and hence are not impinged thereon.

Conventional tobacco smoke filtration depends on a sieving of the particles from the smoke, often combined with absorption into the fibers, such as in the case of cellulose acetate, caused by the provision of a tortuous path for smoke flow.

In the present invention, in the embodiment wherein the filter element is compressed to provide a pressure drop from 5 to 10 inches, it is thought that a degree of sieving filtration occurs along with the impact filtration, thereby accounting for the observed higher filtration efficiency of the compressed filter elements.

The novel filter elements of the present invention when utilized with cigarettes may be the sole filter element of the cigarette, although this may provide some crush problems if a paper sleeve is employed since the filter elements generally lack physical strength. The required structural strength, however, may be provided by the use of a plastic or cardboard sleeve.

In a preferred construction in accordance with this invention, the filter element of this invention forms one element of a multi-element filter. In accordance with this preferred aspect of the present invention, there is provided a self-sustaining cigarette filter for tobacco smoke comprising a plurality of elements and including a substantially air-tight tubular holder, at least a pair of cylindrical air-permeable supporting elements, typically cellulose acetate filter elements, positioned within and in contact with the inner wall of the holder, the pair of supporting elements is spaced apart from each other to define a gap therebetween, the pair of supporting elements and the tubular holder combining to provide sufficient crush-resistance to provide a self-sustaining filter. A third element, consisting of the novel filter element having a diameter substantially that of the holder, is positioned in the gap between the pair of filter elements in engagement with the inner wall of the tubular holder.

In this way, there is provided a filter element which has substantially the strength of the conventional filter and the enhanced tar and nicotine decreasing properties of the microfine polymeric fiber element.

DESCRIPTION OF PREFERRED EMBODIMENT

Figure 1:
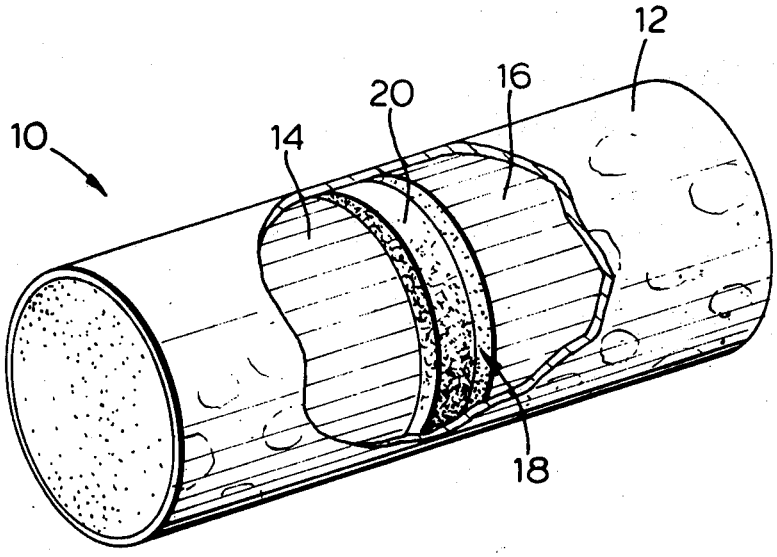
FIG. 1 is a perspective view with parts cut away of a cigarette filter constructed in accordance with one embodiment of the invention.

A cigarette filter embodying the invention is shown in FIG. 1 of the accompanying drawing, wherein a cylindrical filter 10, suitable for a cigarette, consists of three elements. An outer sleeve 12 of cork paper, plastic or any other convenient material, surrounds the elements. Two elements 14 and 16 constitute the majority of the length of the filter and are constructed of conventional filter material, such as cellulose acetate fibers. The elements 14 and 16 are longitudinally displaced from each other a short distance and, in the gap 18, is positioned a third filter element 20. More than two such elements 14 and 16 may be provided, if desired. The third filter element 20 consists of a disc of a mass of polymeric fibers, each of which has a uniform fiber size less than 5 microns. Preferably, in the disc 20 the majority of the fibers are positioned in the disc so that they are transverse to the flow of tobacco smoke. The gap 18 usually is substantially filled by the third filter element 20.

Figure 2:
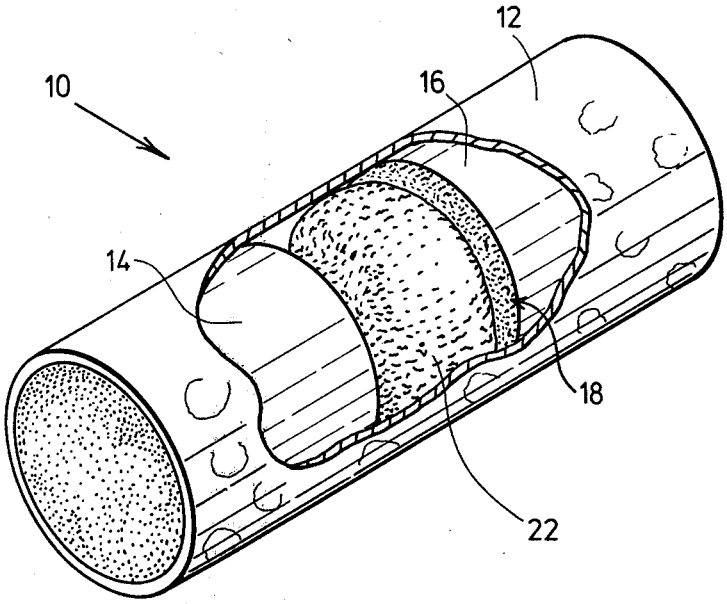
FIG. 2 is a perspective view with parts cut away of a cigarette filter constructed in accordance with a second embodiment of the invention.

It will be seen that the filter disc 20 engages the inside wall of the sleeve 12 and hence is positioned in such a manner that tobacco smoke passing through the filter 10 all pass through the disc. FIG. 2 of the accompanying drawing is a modification of the embodiment of FIG. 1 wherein the disc 20 is replaced by a ball 22; or similar mass of fibers positioned in the gap 18 and engaging the inner wall of the sleeve 12. In order to have efficient reduction of tar and nicotine levels from the smoke, it is necessary for the element 20 or 22 in whatever form it may take to be positioned in the path of the tobacco smoke so that substantially all of the smoke passes through the filter.

Where a ball 22 or other mass of fibers is situated in the gap 18 and engaging the inner wall of the outer sleeve 12, the fibers therein usually are randomly oriented, so that a larger quantity of such material may be required than is the case when a disc is used in which a majority of the fibers are oriented transverse to the flow path of the tobacco smoke.

It is observed that the "taste" of tobacco smoke filtered using the filter of the present invention is superior to that of conventionally-filtered tobacco smoke. It is theorized that this observed effect is due to the essentially different manner of removal of material from the aerosol by the present invention as compared with conventional filters. In the absorption of material using cellulose acetate fibers, taste-producing volatile materials may be absorbed in addition to the tar and nicotine, whereas in the impingement of materials on fine diameter non-absorbent fibers when the filters of the present invention are used, it is possible for the flavorful volatiles in the impinged material to volatilize and enter the filtered air stream passage to the smoker's mouth.

The polymeric materials used in the filters of the present invention may be any natural or synthetic thermoplastic material capable of formation into the fiber diameters required in the present invention. In addition, the material must be capable of withstanding the temperature of the tobacco smoke without substantial degradation and must be substantially inert to chemical attack by the tobacco smoke. Typical examples of materials which may be utilized to provide the fibers are polyolefins, polyesters and polyamides. Polyolefins which may be employed include polyethylene and polypropylene, or polymers of substituted olefins, such as polytrifluorochloroethylene. Many polyesters may be used, such as polyethylene terephthalate. Among the polyamides which may be utilized are nylon 6, nylon 66 and nylon 610. Other thermoplastic polymeric materials also may be employed in the filters of the invention, such as polystyrene and poly(methylmethacrylate). Fibers formed from copolymers also may be used.

While generally the filter element consists of a mass of a single polymeric material, it is possible to utilize a mass of fibers which is a mixture of fibers of two or more polymeric materials.

The filters of the present invention may be formed in any convenient manner. For example, fibers may be melt spun from a die having a plurality of openings therein, so that a mass of fibers is extruded. The mass may be collected and used as such, or may be subjected to physical treatment before use. Polymeric materials having low melting points and low melt viscosities are preferred since the heat required in the spinning operation thereby may be minimized.

While the invention has been described with particular reference to cigarettes, the filters provided by the present invention may be utilized with other tobacco smoking articles, such as, pipes and cigarette and cigar holders.

EXAMPLE

The invention is illustrated further by the following example.

EXAMPLE:

Cigarettes were tested in a smoking apparatus capable of collecting and measuring total particulate solids, which includes tar and nicotine, in smoke. Cigarettes tested were a cigarette with no filter but with porous cigarette paper, a cigarette with a conventional cellulose acetate filter, a cigarette with a filter including a pair of spaced cellulose acetate filters and a disc of uncompressed Acrylite fibers having an average diameter about 1 micron situated therebetween and a similar cigarette with a filter including a pair of spaced cellulose acetate filters and a disc of compressed Acrylite fibers having an average diameter of about 1 micron situated therebetween.

The disc contained 10 mg of fibers, was about 1.5 mm in thickness and had a diameter of about 7.5 mm. Pressure drop across the disc was about 7 inches of water and across the composite filter element about 8.5 inches of water.

The cellulose acetate filter had a pressure drop of about 6 inches of water and in each case the cigarette itself had a pressure drop of about 6 inches of water.

The following Table shows the results obtained:

| Filter type | Total Pressure Drop (inches $H_2O$) | Total Particulate Solids Remaining (mg) | % Removal cf no filter |
|---|---|---|---|
| No filter | 6 | 27 | — |
| Cellulose Acetate | 12 | 16 | 40% |
| Cellulose Acetate Acrylite Fiber (uncompressed) | 14.5 | — | 48%* |
| Cellulose Acetate Acrylite Fiber (compressed) | 10 | 12 | 56% |
| Cellulose Acetate | 14.5 | 10 | 63% |

*Cellulose acetate at 14.5" P.D. result by extrapolation.

The above results indicate the superiority of a filter element constructed in accordance with this invention over conventional cigarette-smoke filtering media. The results show the quantity of tar and nicotine removed by the Acrylite filter is about 30% greater than that removed by the cellulose acetate filter at the same total pressure drop across the cigarette.

SUMMARY

The present invention, therefore, provides a novel filter element for cigarette smoke and a novel method of filtering cigarette smoke using polymeric fibers.

What we claim is:

1. A filter for tobacco smoke comprising a single filter element consisting wholly of a plurality of randomly-oriented non-crimped smooth-surfaced solid fibers of thermoplastic polymeric non-absorbent material, each of said fibers having a uniform diameter less than 5 microns, said filter element having a generally circular cross-section taken across an intended flow path of tobacco smoke and a diameter substantially equal to the diameter of said tobacco smoke flow path, the weight of polymeric material in said filter element exceeding about 6 mg, said filter element having a pressure drop thereacross of from 1 to 10 inches of water at a flow rate of 17.5 ml/sec.

2. The filter of claim 1 wherein said fibers each have a uniform diameter of from about 1 to about 2 microns.

3. The filter of claim 1 wherein said thermoplastic polymeric non-absorbent material is selected from polyolefins, polyesters, polyamides and polystyrene.

4. The filter of claim 1 wherein said thermoplastic polymeric non-absorbent material is poly (methyl methacrylate).

5. The filter of claim 1 in the form of a disc.

6. The filter of claim 1 in the form of a ball.

7. The filter of claim 1 wherein said weight of polymeric material is about 10 mg.

8. The filter of claim 1 wherein said filter element is compressed to provide a pressure drop thereacross of about 7 inches of water at a flow rate of 17.5 ml/sec.

9. The filter of claim 1 wherein said filter element contains about 10 mg of polymeric material, is the form of a disc dimensioned about 7.5 mm diameter and 1.5 mm thickness containing fibers having a diameter of from about 1 to about 2 microns, and has a pressure drop thereacross of about 7 inches of water at a flow rate of 17.5 ml/sec.

10. A self-sustaining elongate filter for tobacco smoke comprising a plurality of elements and including a substantially air tight tubular holder, a pair of cylindrical air-permeable supporting elements positioned within and in contact with the inner wall of the holder, said pair of supporting elements being spaced apart from each other to define a gap therebetween, said at least two supporting elements and said tubular holder combining to provide sufficient crush-resistance to provide a self-sustaining filter, and a third filter element consisting wholly of plurality of randomly-oriented non-crimped smooth-surfaced solid fibers of thermoplastic polymeric non-absorbent material, each of said fibers having a uniform diameter less than 5 microns, said third filter element being positioned in the gap between said pair of supporting elements, said third filter element having a diameter substantially that of said tubular holder and being in engagement with said inner wall, whereby said third filter element is located wholly in the path of flow of tobacco smoke through said filter, the weight of polymeric material in said third filter element exceeding about 6 mg, said third filter element having a pressure drop thereacross of from 1 to 10 inches of water at a flow rate of 17.5 ml/sec.

11. The filter of claim 10 wherein said third filter element is in the form of a disc in which the majority of fibers are oriented transverse to the flow path of tobacco smoke through the filter, the faces of said disc being in engagement with the opposed ends of said pair of filter elements.

12. The filter of claim 10 wherein said third filter element is in the form of a ball.

13. The filter of claim 10 wherein said pair of supporting elements is constituted by a pair of cellulose acetate filter elements.

14. The filter of claim 13 wherein the total pressure drop across said pair of supporting elements is about 1 to 2 inches of water at a flow rate of 17.5 ml/sec.

15. The filter of claim 10 wherein said third filter element contains about 10 mg of polymeric material, is in the form of a disc containing fibers having a diameter of from about 1 to 2 microns and said filter has a pressure drop thereacross of about 7 inches of water at a flow rate of 17.5 ml/sec.

16. The filter of claim 15 wherein the majority of the fibers in said disc are oriented substantially transverse to the axis of said disc.

* * * * *